US010443947B2

(12) United States Patent
Kayser et al.

(10) Patent No.: US 10,443,947 B2
(45) Date of Patent: Oct. 15, 2019

(54) HEAT EXCHANGER WITH COLLECTING CHANNEL FOR DISCHARGING A LIQUID PHASE

(71) Applicant: LINDE AKTIENGESELLSCHAFT, Munich (DE)

(72) Inventors: Stefan Kayser, Trostberg (DE); Steffen Brenner, Trostberg (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 367 days.

(21) Appl. No.: 15/037,099

(22) PCT Filed: Dec. 2, 2014

(86) PCT No.: PCT/EP2014/003208
§ 371 (c)(1),
(2) Date: May 17, 2016

(87) PCT Pub. No.: WO2015/082061
PCT Pub. Date: Jun. 11, 2015

(65) Prior Publication Data

US 2016/0290731 A1 Oct. 6, 2016

(30) Foreign Application Priority Data

Dec. 5, 2013 (EP) ..... 13005656

(51) Int. Cl.

| | |
|---|---|
| ***F28D 9/00*** | (2006.01) |
| ***F28F 9/00*** | (2006.01) |
| ***F28D 21/00*** | (2006.01) |
| ***F25D 5/00*** | (2006.01) |
| ***F25J 5/00*** | (2006.01) |

(52) U.S. Cl.
CPC ..... *F28D 9/0006* (2013.01); *F25J 5/005* (2013.01); *F28D 9/0093* (2013.01); *F28D 21/0017* (2013.01); *F28F 9/005* (2013.01); *F25J 2250/02* (2013.01); *F28D 2021/0064* (2013.01)

(58) Field of Classification Search
CPC .. F28D 9/0006; F28D 9/0093; F28D 21/0017; F28D 1/0213; F28F 9/005; F28F 2025/005; F25J 5/005; F25J 2250/02
See application file for complete search history.

(56) References Cited

U.S. PATENT DOCUMENTS 4,726,418 A 2/1988 Mihailov
5,651,270 A 7/1997 Low et al.
(Continued)

FOREIGN PATENT DOCUMENTS

DE 3424916 A1 1/1986

*Primary Examiner* — Jon T. Schermerhorn, Jr.
(74) *Attorney, Agent, or Firm* — Millen White Zelano & Branigan, PC

(57) ABSTRACT

A heat exchanger for indirectly exchanging heat between a first medium and a second medium, the heat exchanger having a easing enclosing an encased area for receiving the liquid phase of the first medium and at least one plate heat exchanger arranged in the encased area for receiving the first medium and the second medium. The plate heat exchanger is surrounded by the liquid phase of the first medium during operation. A collecting channel is located in the encased area in order to allow for discharge of part of the liquid phase of the first medium from the encased area.

16 Claims, 3 Drawing Sheets

(56) References Cited

U.S. PATENT DOCUMENTS

| | | | | |
|---|---|---|---|---|
| 5,836,382 | A * | 11/1998 | Dingle | F25B 39/028 165/160 |
| 6,543,252 | B1 | 4/2003 | Fuentes et al. | |
| 9,157,690 | B2 * | 10/2015 | Kreis | F28F 9/026 |
| 2001/0030042 | A1 | 10/2001 | Davidian | |
| 2006/0086140 | A1 | 4/2006 | Eaton et al. | |
| 2006/0191672 | A1 * | 8/2006 | Stenhede | F28D 9/0006 165/145 |

* cited by examiner

HEAT EXCHANGER WITH COLLECTING CHANNEL FOR DISCHARGING A LIQUID PHASE

The invention concerns a heat exchanger as shown, for example, in "The standards of the brazed aluminum plate-fin heat exchanger manufacturer's association (ALPEMA)", Third Edition, 2010, Page 67 in FIG. 9-1. It has a casing ("shell"), which surrounds an encased area, together with at least one plate heat exchanger ("core") arranged in the encased area. Such an embodiment of a heat exchanger is also called a "core-in-shell" or a "block-in-shell" heat exchanger.

With such a heat exchanger a first medium, which in operation of the heat exchanger forms a bath surrounding the plate heat exchanger and rises from bottom to top (along the verticals) in the plate heat exchanger (the so-called thermo-siphon effect), can in particular be brought into an indirect heat transfer with a second medium (e.g. a gaseous phase that is to be liquefied, or a liquid phase that is to be cooled), which is preferably led in counter-flow or cross-flow to the first medium in the plate heat exchanger. A gaseous phase of the first medium that is hereby generated is collected in the encased area above the plate heat exchanger and can be discharged from there. Furthermore, at least a part of the liquid phase of the first medium can be discharged out of the encased area via an assigned outlet connecting pipe. At the upper end of the plate heat exchanger the exiting liquid phase, together with the gaseous phase that is being generated, is preferably led back into the bath surrounding the at least one plate heat exchanger.

In a heat exchanger of the type cited above the whole quantity of liquid of the first medium is usually introduced into the encased area through at least one inlet connecting pipe. A part of this liquid flows in the vertical direction downwards, then enters into the at least one plate heat exchanger from underneath, and there is partially vaporized. The other part, namely the liquid phase of the first medium that is to be discharged out of the encased area (this preferably takes the form of a process-related, controlled, and, as far as possible, continuous discharge of fluid from the core-in-shell heat exchanger, and preferably not of a discharge of liquid from the heat exchanger for purposes of evacuating the encased area) flows in a predominantly horizontal direction to the outlet connecting pipe for the liquid phase of the first medium. The maximum volumetric flow rate of this transverse flow thereby occurs in the region of the outlet connecting pipe for the liquid phase of the first medium. Depending upon where the liquid is introduced into the encased area through the at least one inlet connecting pipe, and the hydraulic conditions that are present in the encased area, the horizontal and vertical flows can have a negative effect on each other. Furthermore, relatively high flow velocities can occur in particular at pinch points in the vicinity of the outlet connecting pipe for the liquid phase of the first medium; these can have a negative influence on the operation of the core-in-shell heat exchanger.

Furthermore, in the discharge of the liquid phase of the first medium out of the encased area care is to be taken that no vortices are generated, and that no gas bubbles are carried along with the liquid flow. Furthermore, relatively high flow velocities (in particular local flow velocities) are to be avoided, since otherwise the risk of formation of gas bubbles exists. For this reason, the requirement is often made that no fittings may be allowed to affect the flow in the region of the outlet connecting pipe for the liquid phase of the first medium, and also that no liquid may be introduced into this region of the encased area. This leads to a requirement for a longer casing length, which as a consequence leads to higher costs and more weight.

In order to ensure a minimum liquid level in the encased area, it is proposed in U.S. Pat. No. 5,651,270A that a weir should be arranged within the encased area. The said weir divides the encased area into a heat exchange region and a discharge region. This solution also leads to a requirement for a longer casing length, which as a consequence leads to higher costs and more weight.

Moreover, as a result of the installation of further resistance elements (e.g. weirs) the flow is to some extent severely disturbed in the horizontal direction. For purposes of overcoming each such element of the above-cited type an overpressure is required, which is generated by means of a heightened liquid level ahead of the element. This has the consequence that the areas between the elements have different liquid levels, which can have a negative influence on the operation of the core-in-shell heat exchanger.

The said effect is heightened inasmuch as the overpressure necessary for purposes of overcoming the element in question is a function of the volumetric flow rate. Here it applies that the overpressure must be higher, the higher the volumetric flow rate.

Starting from this basis, the task underlying the present invention is that of providing an improved heat exchanger of the type cited in the introduction. This problem is solved by means of a heat exchanger for the indirect exchange of heat between a first medium and a second medium, with:

a casing, which has an encased area for receiving a liquid phase of the first medium, and at least one plate heat exchanger, which has first heat transfer passages for receiving the first medium, together with second heat transfer passages for receiving the second medium, so that heat can indirectly be exchanged between the two media, wherein the plate heat exchanger is arranged in the encased area such that it can be surrounded with a liquid phase of the first medium located in the encased area, and a collecting channel arranged in the encased area for purposes of discharging the liquid phase of the first medium out of the encased area, the collecting channel has a wall, which defines an interior area of the collecting channel, and which, extended in the longitudinal direction, runs along a horizontal extension direction in the encased area.

A collecting channel, arranged in the encased area, is accordingly provided for purposes of discharging at least a part of the liquid phase of the first medium out of the encased area; this has a wall that defines an interior area of the collecting channel and, extended in the longitudinal direction, runs along a horizontal extension direction in the encased area.

In accordance with one configuration of the invention a plurality of plate heat exchangers can also be provided in the encased area; these can e.g. be operated in parallel, or in series.

Such types of plate heat exchanger have, as a general rule, a number of plates or sheets arranged parallel to one another, which form a multiplicity of heat transfer passages for the media taking part in the heat transfer process. A preferred form of embodiment of a plate heat exchanger has a multiplicity of corrugated or folded sheets (so-called fins), which in each case are arranged between two parallel separating plates or sheets of the plate heat exchanger, wherein the two outermost layers of the plate heat exchanger are formed by cover plates. In this manner a multiplicity of parallel channels, that is to say, heat transfer passages, are formed, through which a medium can flow between each pair of separating plates, or between a separating plate and a cover plate, by virtue of the fins arranged between them in each case. Heat transfer can therefore take place between the media flowing in adjacent heat transfer passages, wherein the heat transfer passages assigned to the first medium are designated as first heat transfer passages, and the heat transfer passages assigned to the second medium are correspondingly designated as second heat transfer passages.

At the sides closure strips (so-called side bars) are preferably provided between each pair of adjacent separating plates, or between a cover plate and the adjacent separating plate, for purposes of closing the respective heat transfer passages. The first heat transfer passages are open upwards and downwards along verticals and in particular are not closed by means of closure strips, so that the liquid phase of the first medium can enter from the bottom into the first heat transfer passages, and at the top of the plate heat exchanger can exit from the first heat transfer passages as a liquid or gaseous phase.

The cover plates, separating plates, fins, and side bars, are preferably manufactured in aluminum, and are e.g. brazed together in a furnace. Via appropriate headers with connecting pipes, media, such as e.g. the second medium, can be introduced into the assigned heat transfer passages, or can be discharged from the latter.

The casing of the heat exchanger can in particular have a (circular) cylindrical peripheral wall, which in the case of a heat exchanger arranged as intended is preferably aligned such that the longitudinal axis (cylindrical axis) of the wall or casing extends along the horizontal. On the end faces the casing preferably has walls located opposite one another and connected with the peripheral wall, which extend transverse to the horizontal, i.e. to the longitudinal axis.

Provision is preferably made for the connecting channel to be arranged in a lower region of the encased area (with reference to a heat exchanger arranged as intended), e.g. on an inner surface of the casing facing towards the interior area. The connecting channel is preferably arranged between the casing, in particular the peripheral wall of the casing, and the at least one plate heat exchanger. Furthermore, provision is preferably made for the connecting channel to be arranged along the vertical underneath the at least one plate heat exchanger. Furthermore, the plate heat exchanger can be arranged along the horizontal also alongside the plate heat exchanger. The connecting channel is thereby preferably arranged along the vertical below the surface of the liquid phase of the first medium in the encased area, so that the liquid phase of the first medium can accordingly be discharged out of the encased area using the connecting channel.

With reference to the mode of operation of the heat exchanger provision is preferably made, as already set out in the introduction, for the at least one plate heat exchanger to be designed for the purpose of cooling and/or at least partially liquefying the second medium led through the second heat exchanger passages counter to the first medium led through the adjacent first heat transfer passages, such that a gaseous phase of the first medium is formed, wherein the encased area is designed so as to collect the gaseous phase.

Furthermore, provision is preferably made for the at least one plate heat exchanger to be designed such that during operation of the heat exchanger the first medium rises in the at least one plate heat exchanger, namely in the first and/or second heat transfer passages of the at least one plate heat exchanger provided for this purpose, wherein in particular, the at least one plate heat exchanger is designed for the purpose of leading the second medium through the second heat transfer passages in counter-flow or cross-flow to the first medium.

For purposes of discharging the liquid phase of the first medium the collecting channel is preferably connected in terms of fluid flow with an outlet connecting pipe, which in particular is arranged on a lower face of the casing, such that the liquid phase of the first medium can be discharged from the collecting channel via that outlet connecting pipe. The collecting channel can also be connected in terms of fluid flow with a plurality, for example two or three, outlet connecting pipes, which are preferably arranged in a distributed manner over the length of the collecting channel.

In one form of embodiment of the invention provision is furthermore made for the collecting channel to extend along an extension direction, which is aligned parallel to the longitudinal axis (cylindrical axis) of the casing, that is to say along the horizontal, and thereby, preferably transverse to the said extension direction (longitudinal axis), has an e.g. tubular (in particular circular) or e.g. a cornered, in particular a rectangular, cross-section. The collecting channel preferably extends over at least 60%, 70%, 80% or 90% of the length of the heat exchanger along the extension direction, preferably over the whole length of the encased area of the heat exchanger along the extension direction.

Furthermore, the collecting channel preferably has a wall that surrounds an interior area of the collecting channel, in which the liquid phase can flow to the said outlet connecting pipe. Here that region of the wall of the collecting channel, which points towards a lower face of the heat exchanger, that is to say, points along the vertical downwards, is designated as the lower face of the collecting channel, and the opposite region of the wall of the collecting channel, which points towards the upper face of the heat exchanger, correspondingly represents the upper face of the collecting channel. The upper and lower faces of the collecting channel are preferably connected with one another by means of side walls of the collecting channel extending along the longitudinal axis of the casing. At its ends the collecting channel is preferably bounded by end faces located opposite one another, which in each case connect the upper and lower faces and the side walls with one another. The collecting channel can also be configured so as to be open at its ends.

One variant of the invention furthermore provides for one or a plurality of the above-cited regions of the wall of the collecting channel to be formed by the casing of the heat exchanger. The lower face of the collecting channel, that is to say, the lower face of the wall of the collecting channel, is preferably formed by the casing of the heat exchanger. The sidewalls and end faces are thus correspondingly attached to the casing from the encased area.

For purposes of discharging the liquid phase the collecting channel preferably has at least one inlet opening, particularly preferably a number of inlet openings, which in particular is or are designed on the upper face of the collecting channel, and also, if required, on the sidewalls of the collecting channel that are located opposite one another. Here the inlet openings formed on the upper face of the collecting channel are preferably designed in the form of slots, whereas any inlet openings provided on the side walls preferably have a circular contour (e.g. drilled holes).

Provision is preferably made for the distances between adjacent inlet openings, in particular the distances between the inlet openings provided on the upper face or on the side walls, to decrease towards the respective end faces of the collecting channel. That is to say, two adjacent inlet openings that are located close to one of the end faces of the collecting channel preferably have a smaller distance between them along the extension direction of the collecting channel than two adjacent inlet openings that are arranged nearer to the center of the collecting channel (with reference to the extension direction).

The number, distribution, size and/or shape of the inlet openings are preferably chosen such that the velocity field of the liquid phase of the first medium is preferably uniform in the collecting channel. In particular, the flow in the adjacent encased area should also thereby be negatively influenced as little as possible.

Furthermore, in accordance with one aspect of the invention, the cross-sectional surface area (and, if required, the contour) of the collecting channel in a plane at right angles to the extension direction of the collecting channel is selected such that a preferably uniform velocity field of the liquid phase of the first medium ensues in the collecting channel. In particular, the flow in the adjacent encased area should also thereby be negatively influenced as little as possible.

This is preferably aided by an expansion/enlargement of the cross-section of the collecting channel up to the outlet connecting pipe and/or by a defined arrangement, shape and size of the inlet openings on the collecting channel.

The outlet connecting pipe preferably opens out centrally into the collecting channel, that is to say into the interior area of the collecting channel.

Furthermore, the heat exchanger can have a number of inventive collecting channels arrange in the encased area, which are connected in terms of fluid flow with the outlet connecting pipe or with one or a plurality of outlet connecting pipes in each case.

Here the positions, dimensions and alignments of the said collecting channels are preferably chosen such that the velocity field of the liquid phase of the first medium is preferably uniform in the respective collecting channel.

Furthermore, the casing can, of course, also have a number of outlets connecting pipes, which can be connected with a collecting channel as described above, or, if required, with a plurality of collecting channels of the type described above.

Finally, in accordance with another form of embodiment of the invention provision can be made for the inlet openings, in particular the inlet openings on the sidewalls of the collecting channel, to have a defined separation distance along the vertical from the inner surface of the casing on the lower face of the casing. This enables a restriction of the liquid discharge, e.g. if the plant is not in operation, or in the event of an interruption of the inlet flow (i.e. a defined residual amount remains in the encased area).

Furthermore, a restriction of the liquid discharge can also be achieved by an appropriate arrangement of the collecting channel in the encased area, for example, by arranging the collecting channel at a defined height above the lower face of the casing.

Furthermore, individual or all inlet openings can be provided with vortex breakers, which prevent the generation or intensification of vortices. In principle each inlet opening can be configured individually.

By means of the inventive solution the velocity field in the core-in-shell heat exchanger can, in particular, be better controlled. By this means the overall size of the receiving area, i.e. the encased area, can be better utilized. Depending upon the particular operating requirements, smaller casing sizes can, in particular, be achieved.

Furthermore, by a suitable positioning of the collecting channel (e.g. underneath the plate heat exchanger) and the configuration of the inlet openings, the generation of vortices can be prevented, as can the carrying along of gas with the liquid flow.

Furthermore, relatively high (local) flow velocities can be avoided by the inventive configuration of the collecting channel.

Moreover, by suitable positioning of the inlet openings the liquid to be discharged can be extracted in a targeted manner from regions of the receiving area, i.e. the encased area, in which little liquid flows downwards in the vertical direction for purposes of partial vaporization in the plate heat exchanger. In this manner in particular the flows are prevented from having a negative influence on one another.

As a result of the smaller casing size that can be implemented the total costs of the inventive heat exchanger are advantageously reduced with respect to material, production and maintenance. The cost of insulation is also lower.

Furthermore, the collecting channel is a non-pressurized component and need therefore only satisfy lower requirements as regards wall thickness, material and production. Moreover, its cross-sectional shape can be freely configured without this affecting its strength.

Furthermore, the positions of the liquid connecting pipes of the core-in-shell heat exchanger are more variable. For example, the outlet connecting pipe on the lower face of the casing can be arranged centrally or at the edge. As a result, the design of the surrounding components is less restricted.

BRIEF DESCRIPTIONS OF THE DRAWINGS

Further details and advantages of the invention are to be explained by the following description of an example of embodiment with the aid of the figures.

Figure 1:
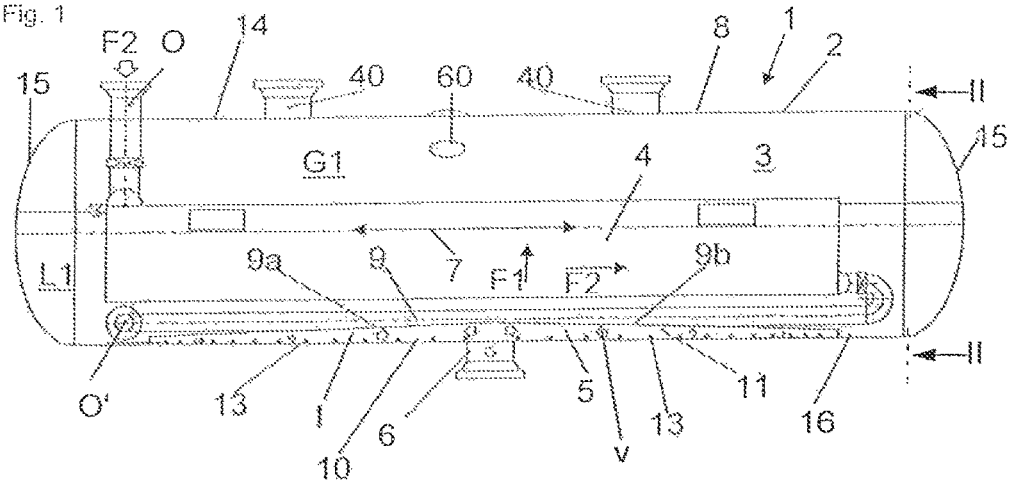
FIG. 1 shows a view in cross-section of an inventive heat exchanger.
Figure 2:
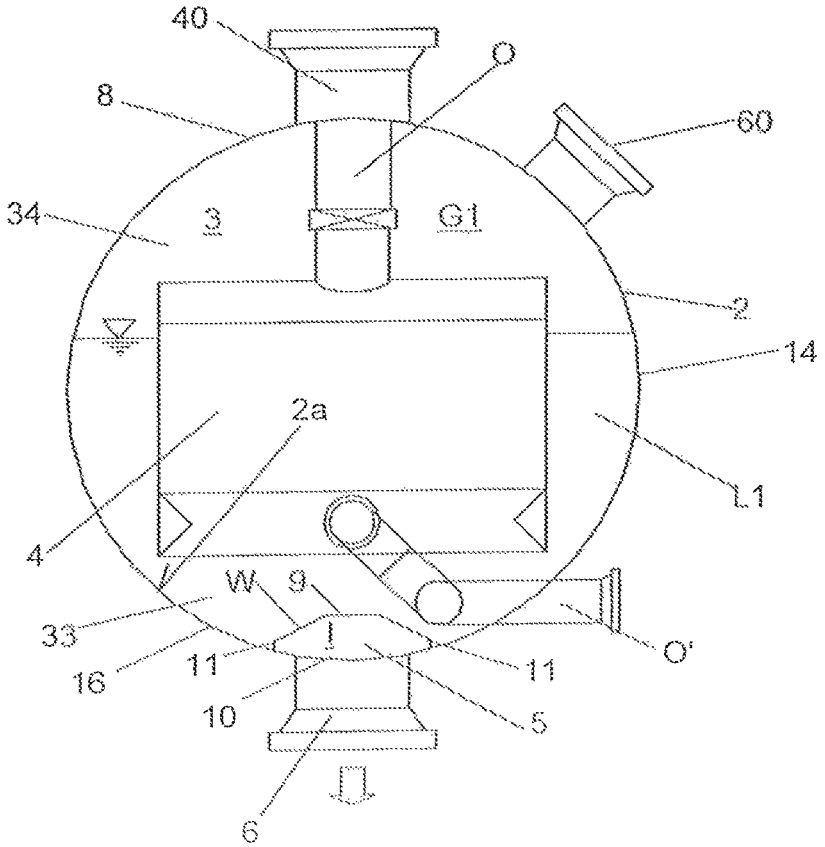
FIG. 2 shows a further view in cross-section of the heat exchanger along the line II-II in FIG. 1.
Figure 3:
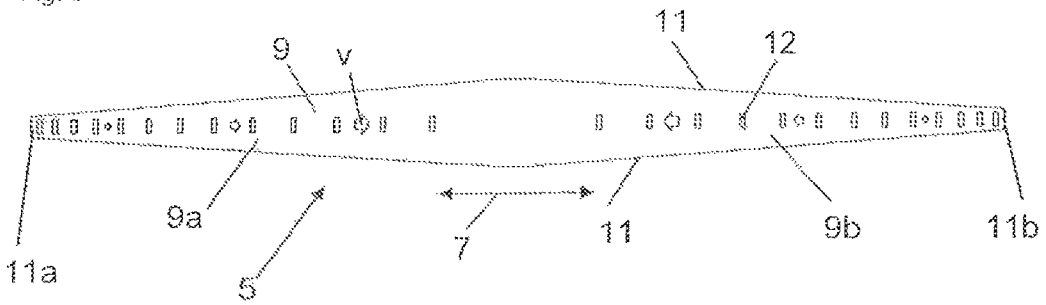
FIG. 3 shows a plan view onto an inventive collecting channel of the heat exchanger in accordance with FIGS. 1 and 2.

FIG. 1 shows, in conjunction with FIGS. 2 and 3, a heat exchanger 1, which has a transverse (circular) cylindrical casing 2, which bounds an encased area 3 of the heat exchanger 1. Here the casing 2 has a cylindrical peripheral wall 14, which is bounded on its end faces by two walls 15 located opposite one another.

Figure 4:
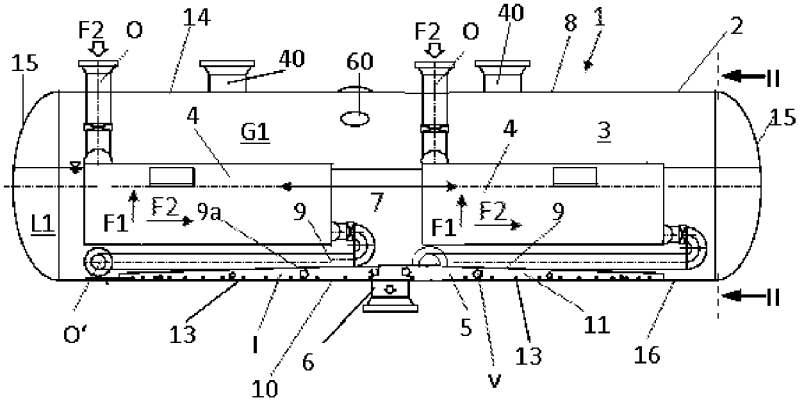
FIG. 4 shows a cross section view of the heat exchanger of FIG. 1 with two plate heat exchangers.

As shown in FIG. 1, a plate heat exchanger 4 is arranged in the encased area 3 enclosed by the casing 2; this has a plurality of parallel heat transfer passages. FIG. 4 illustrates an embodiment in which a plurality of plate heat exchangers 4 are arranged in the encased area 3 enclosed by the casing 2.

The plate heat exchanger 4 here has a number of e.g. corrugated or folded sheets (so-called fins), which in each case are arranged between two plane separating plates or sheets of the plate heat exchanger 4. In this manner a multiplicity of parallel channels, that is to say, heat transfer passages, are formed between each pair of separating plates (or between a separating plate and a cover plate, see below), through which the respective medium F1, F2 can flow. The two outermost layers are formed by cover plates of the plate heat exchanger 4; to the sides cover plates are provided between each pair of adjacent separating plates, or separating plates and cover plates.

During operation of the heat exchanger 1 the encased area 3 is filled with a first medium F1 via an inlet connecting pipe 60 that is provided on an upper face 8 of the casing 2. This inlet flow into the heat exchanger 1 is usually two-phase, but can also be solely in liquid form. The liquid phase L1 of the first medium F1 then forms a bath surrounding the plate heat exchanger 4, wherein the gaseous phase G1 of the first medium F1 collects above the liquid phase L1 in an upper region 34 of the encased area 3.

The liquid phase L1 of the first medium F1 can rise in assigned first heat transfer passages of the plate heat exchanger 4, and thereby is partially vaporized as a result of indirect heat transfer from a second medium F2 that is to be cooled, which, e.g. in cross-flow to the first medium F1, is led in assigned second heat transfer passages of the plate heat exchanger 4. The gaseous phase G1 of the first medium F1 that is thereby generated can exit at an upper end of the plate heat exchanger 4 and rises in the encased area 3 of the heat exchanger 1, from where it can be discharged via appropriate outlet connecting pipes 40 on the upper face 8 of the casing 2.

Furthermore, a part of the liquid phase L1 circulates in the encased area 3, wherein that part is raised from bottom to top in the plate heat exchanger 4 in the first heat transfer passages, and then once again flows downwards in the encased area 3 outside the plate heat exchanger 4.

The second medium F2 is led into the plate heat exchanger 4 via a suitable inlet connecting pipe O, and after passing through the assigned second heat transfer passages is discharged from the plate heat exchanger 4 in a cooled or liquefied state via an outlet connecting pipe O'.

A box-shaped collecting channel 5 is arranged on the lower face 16 of the heat exchanger 1, on an inner surface 2*a* of the casing 2 facing towards the encased area 3; the collecting channel 5 extends along an extension direction 7. Here the collecting channel is, in particular, designed in an elongated manner, and accordingly has a larger extent along the extension direction 7 than it has transverse to the same extension direction 7.

Furthermore, the collecting channel 5 has a wall W, which bounds an interior area I of the collecting channel 5, through which the liquid phase L1 of the first medium F1 can be discharged out of the encased area 3. In detail the wall W has an upper face 9, together with two side walls 11 extending from the latter, which extend along the extension direction 7 and are connected with one another via a floor (lower face) 10 of the collecting channel 5 located opposite to the upper face 9, which floor is formed by the casing 2. Furthermore, the collecting channel 5, that is to say, its wall W, has two end faces 11*a*, 11*b*, which are located opposite one another along the extension direction 7.

For purposes of an, in particular continuous, discharge of the liquid phase L1 of the first medium F1 out of the encased area 3 during operation of the heat exchanger 1, inlet openings 13, preferably circular-shaped, are now provided on the sidewalls 11, and/or inlet openings 12, preferably slot-shaped, are now provided on the upper face 9 of the collecting channel 5, through which the liquid phase L1 can enter into the collecting channel 5. The inlet openings 12, 13 are thereby arranged next to one another along the extension direction 7, wherein the distance between adjacent inlet openings 12, 13, starting from the outlet connecting pipe 6, preferably reduces along the extension direction 7 towards each of the two end faces 11*a*, 11*b* of the collecting channel 5. At the same time the longitudinal axes of the slot-shaped inlet openings 12 in each case run transverse to the extension direction 7 of the collecting channel 5.

The collecting channel 5 is furthermore connected with an outlet connecting pipe 6 of the casing 2, which enters into the collecting channel 5 on the lower face 10 of the collecting channel 5, such that the liquid phase L1 of the first medium F1 that has entered into the interior area I of the collecting channel 5 can be discharged from the collecting channel 5 via the outlet connecting pipe 6.

The outlet connecting pipe 6 is preferably arranged centrally on the collecting channel 5, along the extension direction 7, wherein the upper face 9 of the connecting channel 5 preferably has two sections 9*a*, 9*b* rising towards the outlet connecting pipe 6, which preferably meet above the outlet connecting pipe 6.

Starting from the end faces 11*a*, 11*b*, the cross-section of the collecting channel 5 in each case preferably increases (widens) in the direction towards the outlet connecting pipe 6 in order to obtain as homogeneous a velocity field of the liquid phase L1 of the first medium F1 as possible in the collecting channel 5. In particular, the flow of the liquid phase L1 in the adjacent encased area 3 should also thereby be negatively influenced as little as possible.

LIST OF REFERENCE SYMBOLS

1 Heat exchanger
2 Casing
2*a* Inner surface
3 Encased area
4 Plate heat exchanger
5 Collecting channel
6 Outlet connecting pipe
7 Extension direction
8 Upper face of the casing
9 Upper face of the collecting channel
9*a*, 9*b* Upper face sections
10 Lower face of the collecting channel
11 Side walls of the collecting channel
11*a*, 11*b* End faces
12 Slot-shaped inlet openings
13 Circular-shaped inlet openings
14 Peripheral wall of the casing
15 End face walls of the casing
16 Lower face of the casing
33 Lower region of the encased area
34 Upper region of the encased area
40 Outlet connecting pipe for the gaseous phase
60 Inlet connecting pipe
F1 First medium
L1 Liquid phase of the first medium
G1 Gaseous phase of the first medium
F2 Second medium
1 Interior area of the collecting channel
O Inlet connecting pipe for the second medium
O' Outlet connecting pipe for the second medium
Velocity field of the liquid phase L1
W Peripheral wall of the collecting channel

The invention claimed is:

1. A heat exchanger for the indirect exchange of heat between a first medium and a second medium, said heat exchanger comprising:

a casing having a longitudinal axis and defining an encased area for receiving a liquid phase of the first medium, wherein said longitudinal axis extends in a horizontal direction, a plate heat exchanger having first heat transfer passages for receiving the first medium, and second heat transfer passages for receiving the second medium, said first and second heat exchange passages permitting heat to be indirectly be exchanged between the first and second mediums, wherein the plate heat exchanger is arranged within the encased area such that the plate heat exchanger can be surrounded with a liquid phase of the first medium located in the encased area, a collecting channel arranged in the encased area for collecting the liquid phase of the first medium located in the encased area before it can be discharged from the casing, and an outlet connecting pipe connected to the casing and in direct fluid communication with the collecting channel for discharging the collected liquid phase from the casing, wherein the collecting channel comprises a wall fixed to the casing at a position underneath the plate heat exchanger such that the wall and the casing together define an interior area of the collecting channel, and said wall having a longitudinal axis which extends substantially parallel to said longitudinal axis of said casing, and wherein said wall comprises a top wall part arranged between the plate heat exchanger and the casing, and a side wall part extending from the perimeter of the top wall part to directly contact the casing such that the side wall part circumscribes the interior area between the top wall part and the casing.

2. The heat exchanger in accordance with claim 1, wherein the collecting channel is arranged below said longitudinal axis of said casing.

3. The heat exchanger in accordance with claim 1, wherein said encased area includes a region above the plate heat exchanger wherein a gaseous phase of the first medium, generated by the indirect exchange of heat between the first medium and the second medium within said plate heat exchanger, can be collected.

4. The heat exchanger in accordance with claim 1, wherein the first heat transfer passages of the plate heat exchanger are arranged so that the first medium can flow vertically in the first heat transfer passages, and the second heat transfer passages are arranged so that the second medium can flow in counter-flow with respect to flow of the first medium.

5. The heat exchanger in accordance with claim 1, wherein said encased area contains a plurality of plate heat exchangers.

6. The heat exchanger in accordance with claim 1, wherein the wall of the collecting channel is below said longitudinal axis.

7. The heat exchanger in accordance with claim 1, wherein the outlet connecting pipe opens centrally, with respect to the longitudinal extent of the wall, into the interior area of the collecting channel.

8. The heat exchanger in accordance with claim 1, wherein transverse to the longitudinal axis of the wall, the interior area of the collecting channel has a cross-section that increases towards the outlet connecting pipe.

9. The heat exchanger in accordance with claim 1, wherein the collecting channel has a plurality of inlet openings for inflow of the liquid phase of the first medium into the collecting channel, wherein the inlet openings are formed in the top wall part and/or the side wall part.

10. The heat exchanger in accordance with claim 9, wherein said collecting channel further comprises two end wall parts connected to said top wall part and said side wall parts and wherein said inlet openings are arranged next to one another in said top wall part and/or said side wall part along the longitudinal axis of the wall and the distance between adjacent inlet openings reduces from a center of the wall towards longitudinal ends of the wall.

11. The heat exchanger in accordance with claim 9, wherein said inlet openings are provided in said top wall part and are slot shaped, and said inlet openings are provided in said side wall part and are circular in shape.

12. The heat exchanger in accordance with claim 1, wherein the casing comprises a cylindrical wall formed about the longitudinal axis of the casing and two end walls that are transverse to the longitudinal axis of the casing, and wherein said cylindrical wall connects said two end walls to one another.

13. The heat exchanger in accordance with the claim 12, wherein the outlet connecting pipe is arranged in said cylindrical wall below said collecting channel of the casing.

14. The heat exchanger in accordance with claim 12, wherein transverse to the longitudinal axis of the wall, the interior area of the collecting channel has a cross-section that increases towards the outlet connecting pipe.

15. The heat exchanger in accordance with claim 14, wherein the collecting channel has a plurality of inlet openings for inflow of the liquid phase of the first medium into the collecting channel, wherein the inlet openings are formed in the top wall part and/or the side wall part of the collecting channel.

16. The heat exchanger in accordance with claim 1, wherein the first heat transfer passages of the plate heat exchanger are arranged so that the first medium can flow vertically in the first heat transfer passages, and the second heat transfer passages are arranged so that the second medium can flow in cross-flow with respect to flow of the first medium.

* * * * *